United States Patent [19]

Busenhart et al.

[11] Patent Number: 4,811,910

[45] Date of Patent: Mar. 14, 1989

[54] CHUCK STRUCTURE

[75] Inventors: Peter Busenhart, Winterthur; Ruedi Schneeberger, Seuzach; Erwin Holbein, Uttwil; Armin Wirz, Ossingen; Adolf Flueli; Hansueli Maier, both of Winterthur, all of Switzerland

[73] Assignee: Rieter Machine Works Limited, Winterthur, Switzerland

[21] Appl. No.: 911,816

[22] Filed: Sep. 26, 1986

[30] Foreign Application Priority Data

Oct. 2, 1985 [GB] United Kingdom ..... 8524303

[51] Int. Cl.[4] ..... B65H 54/20; B65H 54/54

[52] U.S. Cl. ..... 242/18 R; 242/18 PW; 242/35.5 R; 242/46.4

[58] Field of Search ..... 242/46.2, 46.3, 46.4, 242/72, 72.1, 68.2, 18 R, 18 PW, 18 A, 35.5 R

[56] References Cited

U.S. PATENT DOCUMENTS

| | | | |
|---|---|---|---|
| 2,931,587 | 4/1960 | Pistor | 242/18 PW |
| 3,030,039 | 4/1962 | Roberts | 242/18 PW |
| 3,526,369 | 9/1970 | Beckwith, Jr. | 242/46.4 |
| 4,014,476 | 3/1977 | Turk et al. | 242/18 A |
| 4,036,446 | 7/1977 | Schar | 242/46.4 X |
| 4,056,237 | 11/1977 | Miller et al. | 242/18 PW |
| 4,155,512 | 5/1979 | Bauch et al. | 242/18 R |
| 4,186,890 | 2/1980 | Miller | 242/18 A |
| 4,241,883 | 12/1980 | Benin | 242/46.4 |
| 4,336,912 | 6/1982 | Greb | 242/46.4 |
| 4,429,838 | 2/1984 | Lenk et al. | 242/46.4 |
| 4,458,850 | 7/1984 | Sugioka et al. | 242/46.4 |
| 4,460,133 | 7/1984 | Turk et al. | 242/18 A X |

FOREIGN PATENT DOCUMENTS 2914923 10/1980 Fed. Rep. of Germany .

*Primary Examiner*—Stanley N. Gilreath

*Attorney, Agent, or Firm*—Werner W. Kleeman

[57] ABSTRACT

There are disclosed one-piece chuck structures for use in winding machines and particularly, but not exclusively, for use in high speed winding machines for the take-up of synthetic plastics filament. These one-piece chuck structures comprise a first elongated tubular portion adapted to receive one or more bobbin tubes and a second elongated tubular portion integral with the first elongated tubular portion and of reduced external diameter relative thereto. Bearings cooperate with the exterior of the second elongated tubular portion such that the first elongated tubular portion and the second elongated tubular portion are rotatable about a common longitudinal axis. Also disclosed are hollow bobbin tube-engaging elements as well as double-arm tube-positioning members which can be used with such and other chuck structures.

2 Claims, 9 Drawing Sheets

Fig. 11
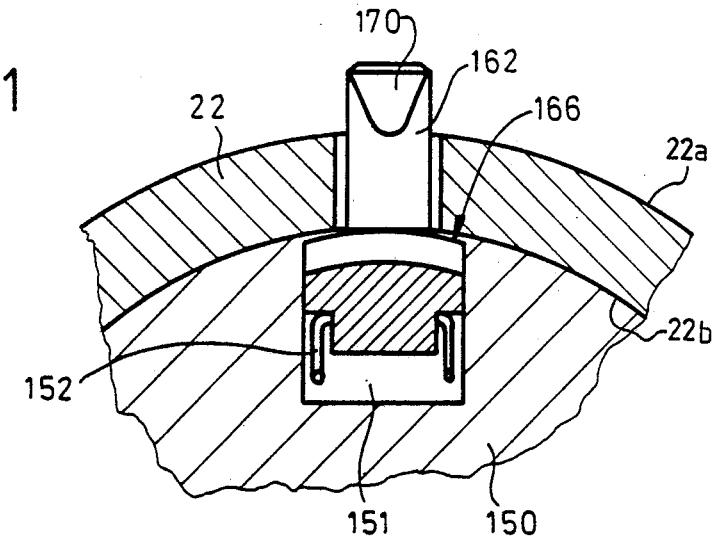
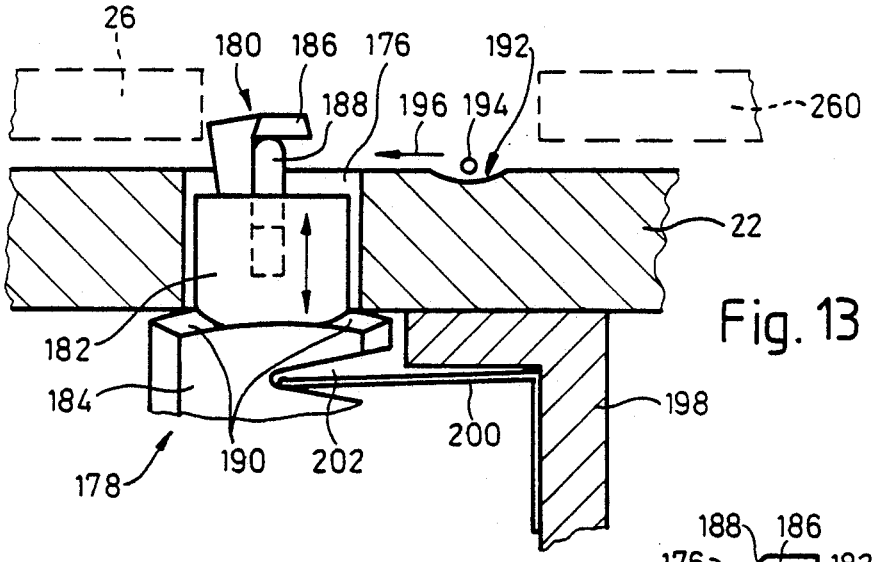
Fig. 13
Fig. 14
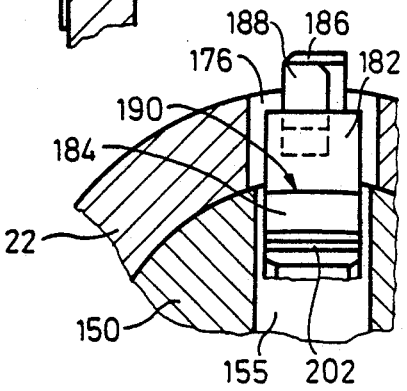

CHUCK STRUCTURE

BACKGROUND OF THE INVENTION

The present invention broadly relates to chuck structures for winding machines and, more specifically, pertains to a new and improved construction of a chuck structure for use in winding machines and particularly, but not exclusively, for use in high speed winding machines for the take-up of synthetic plastics filament. In this context, "high-speed" refers to speeds in excess of 3000 m/min. and especially to speeds in excess of 5000 m/min.

Generally speaking, the present invention relates to a new and improved construction of a chuck for cantilever-mounting in a winder for rotation about a longitudinal chuck axis, and to elements and devices for use in such chucks. When used hereinafter in this specification, the word "chuck" relates to a chuck as defined in this paragraph.

In other words, one aspect of the present invention relates to a chuck having an axis of rotation, while a second aspect relates to a bobbin tube-engaging element for mounting in a chuck for movement radially thereof between an operating position engaging the interior of a bobbin tube and an inoperative or idle position for enabling release of the bobbin tube.

Filament winders designed for the take-up of synthetic plastics filament can be classified into two types those intended for taking-up relatively coarse (heavy denier or heavy titre) filaments and those intended for taking-up relatively fine filaments. The coarser filaments are normally used for industrial purposes, e.g. in tire cord and in carpet yarn; the finer filaments are generally used for textile purposes. The coarser filaments have a much greater rupture or breaking strength than the finer filaments. The difference in the breaking strength of the two filament types has in the past exerted a substantial influence on the design of the chuck or chucking device (also referred to as "spindle" or "mandrel") used in continuous or wasteless winders. Examples of such winders can be found in European Published Patent Application No. 73,930 and U.S. Pat. Nos. 4,298,171, granted Nov. 3, 1981; 4,014,476, granted Mar. 29, 1977; and 4,186,890, granted Feb. 5, 1980. Examples of chucks for such winders can be found in U.S. Pat. Nos. 4,336,912, granted June 29, 1982; and 4,460,133, granted July 17, 1984.

As will be seen from the prior patents referred to above, a continuous winder comprises at least two chucks, one of which is held on standby, i.e. in readiness, while a package is being formed on the other chuck. When the package is complete, a chuck changeover operation is effected in the course of which the thread being wound is transferred to the "incoming" chuck while the "outgoing" chuck is moved to a doffing position. In the doffing position, the completed package can be removed from the outgoing chuck and replaced by a fresh bobbin tube, ready for another changeover as an incoming chuck when the current package winding operation is completed.

In continuous winders it is necessary to catch the thread on the incoming chuck and to sever the thread between the incoming and outgoing chucks. For relatively fine filaments, it is possible to provide catching slots in the bobbin tubes and to rely upon tearing or rupture of the filament between the incoming and outgoing chucks after catching the filament on the incoming chuck. For relatively coarse filaments, however, it has heretofore been necessary to incorporate catching and severing devices in the chuck structures, for example as described in U.S. Pat. Nos. 4,106,711, granted Aug. 15, 1978 and 4,477,034, granted Oct. 16, 1984; in the aforementioned U.S. Pat. Nos. 4,336,912 and 4,460,133; and in European Pat. No. 470.

Chucks designed for use with relatively fine filaments generally include a tube functioning simultaneously as an outer casing or shell of the chuck and as the major structural element thereof, providing the cantilever-mounted chuck with both strength and rigidity n operation. This tube is generally secured at one end to a hollow stub shaft cooperating with bearings in the cantilever mounting for the chuck in the winder. However, the join or connection between the stub shaft and the tube inevitably reduces the space available within the end portion of the tube and production of an adequate join or connection can therefore give rise to problems. The space within the tube is always important for the design of the bobbin tube clamping and locating systems accommodated within the tube in use.

A different chuck design is generally used for relatively coarse filaments. In this alternative design, the major structural element providing strength and rigidity to the chuck is a longitudinal "core" tube. The thread-catching and severing structures and the bobbin tube clamping systems are carried on the exterior of this core tube, and the assembly is partially enclosed in a surrounding casing or shell. The latter has, however, no structural function, and it is discontinuous to enable access of the thread to the catching and severing structures.

For given materials forming the load-bearing tube, and for a given proportion of the chuck cross-section allocated to that tube, a chuck of the second type will be neither as strong nor as rigid as an equivalent chuck of the first type. Furthermore, the externally mounted elements are not as securely retained as corresponding elements in a chuck of the first type.

The present invention provides a combination of features which, at least in certain operating circumstances, presents significant advantages over both of the types referred to above.

SUMMARY OF THE INVENTION

Therefore, with the foregoing in mind, it is a primary object of the present invention to provide a new and improved construction of a chuck structure which does not exhibit the aforementioned drawbacks and shortcomings of the prior art constructions.

Yet a further significant object of the present invention aims at providing a new and improved construction of a chuck structure of the character described which is relatively simple in construction and design, extremely economical to manufacture, highly reliable in operation, not readily subject to breakdown and malfunction and requires a minimum of maintenance and servicing.

It is a further significant object of the present invention to provide a new and improved construction of a chuck for winding threads, particularly coarse threads which has properties of strength and rigidity comparable to those of chucks for winding fine threads, for given sizes and proportions of the chuck.

Another significant object of the present invention aims at providing a chuck of the type previously described which provides more positive and accurate location and fixing of bobbin tubes thereon in axial and circumferential directions and more accurate centering in the radial direction.

Now in order to implement these and still further objects of the invention, which will become more readily apparent as the description proceeds, according to a first embodiment of the chuck the chuck structure of the present invention is manifested by the features that it comprises a first elongated tubular portion with an external circumference adapted to receive one or more bobbin tubes for rotation about the chuck axis to enable formation of a package in use. This first tubular portion has an internal chamber containing devices cooperable with a bobbin tube in operation. The chuck further comprises a second elongated tubular portion integral with the first but of reduced external diameter relative to the first. The first and second portions have a common longitudinal axis. Bearing means are provided cooperating with the exterior of the second portion so that the first and second portions are rotatable about their common axis.

Preferably, both the first and second portions are made of steel. The second portion may be provided at its end remote from the first portion with a coupling enabling transmission of a fluid pressure medium, preferably air, to the interior of the chamber in the first portion via the hollow interior of the second portion.

A further embodiment of the invention is manifested by the features that it comprises a bobbin tube-engaging element for mounting in a chuck for movement radially thereof between an operating position engaging the interior of a bobbin tube and an inoperative or idle position releasing or enabling release of the bobbin tube. The bobbin tube-engaging element comprises a head portion having a surface adapted to engage the bobbin tube, a hollow body portion and a foot portion having a surface adapted to slide on a wedging or camming member for moving the bobbin tube-engaging element between the operative and inoperative positions. The foot portion may have projections preventing the bobbin tube-engaging element from passing through an opening in a casing portion of the chuck. The hollow body portion may be open at the foot end thereof. The surface of the foot portion adapted to slide on the wedging or camming member may then comprise a rim at the foot end of the hollow body portion together with the surfaces on the projections. The bobbin tube-engaging element is preferably made in one piece from a lightweight material such as a plastic material. A bobbin tube-engaging element of this type has a low mass in comparison to a solid bobbin tube-engaging element, and thus is subjected to relatively low centrifugal forces in operation. A chuck design incorporating such bobbin tube-engaging elements can therefore be arranged to ensure that, in use, the bobbin tube-engaging element is contacted at all times by the wedging or camming member and can be centered by the wedging or camming member relative to the chuck.

Another embodiment of chuck structure according to the present invention is manifested by the features that it comprises an elongated tubular portion rotatable about the longitudinal chuck axis with an outer circumference adapted to receive one or more bobbin tubes for rotation therewith to form . a package in use, the tubular portion being formed with an internal chamber. The tubular portion has at least one pair of openings and an associated bobbin tube-positioning member with first and second arms. The bobbin tube-positioning member is arranged in the chamber for movement between a first position, in which the first arm passes through one opening of the at least one pair of openings to project beyond the outer circumference of the tubular portion while the second arm is located within that outer circumference, and a second position in which the second arm passes through the other opening of the pair to project beyond the outer circumference of the tubular portion while the first arm is located within that outer circumference. The bobbin tube-positioning member may have a generally semi-circular configuration. Means can be provided within the chamber to urge the bobbin tube-positioning member into one of the aforementioned first and second positions. In comparison with known types of bobbin tube-positioning members, for example, as disclosed in U.S. Pat. No. 4,056,237, granted Nov. 1, 1977, the arrangement defined above provides substantially improved guidance and retention of the bobbin tube-engaging member in the tubular portion.

In this last mentioned embodiment of chuck structure the elongated tubular portion referred to in the above definition may be the first tubular portion referred to hereinbefore in the definition of the first embodiment of chuck structures. However, the various embodiments of the invention defined herein are usable independently of each other.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIG. 11 shows a transverse section of a detail taken from FIG. 10;

FIG. 13 is a longitudinal section of a further detail taken from FIG. 10; and FIG. 14 shows a transverse section of the detail shown in FIG. 13.

DETAILED DESCRIPTION OF THE PREFERRED EMBODIMENTS

Describing now the drawings, it is to be understood that to simplify the showing thereof, only enough of each of the chuck structures and related components have been illustrated therein as is needed to enable one skilled in the art to readily understand the underlying principles and concepts of the present invention. The chucks referred to below in the description of the drawings are intended for use in filament winding machines as disclosed in U.S. Pat. No. 4,298,171 and European Pat. No. 73,930. The full disclosure of each of those specifications is incorporated in the present specification by reference. The function of the chucks in use is assumed to be known from those prior specifications and will not be specifically disclosed herein. It will be clear to persons skilled in the art that chucks based on the relevant principles could be used in other winder designs.

Figure 1:
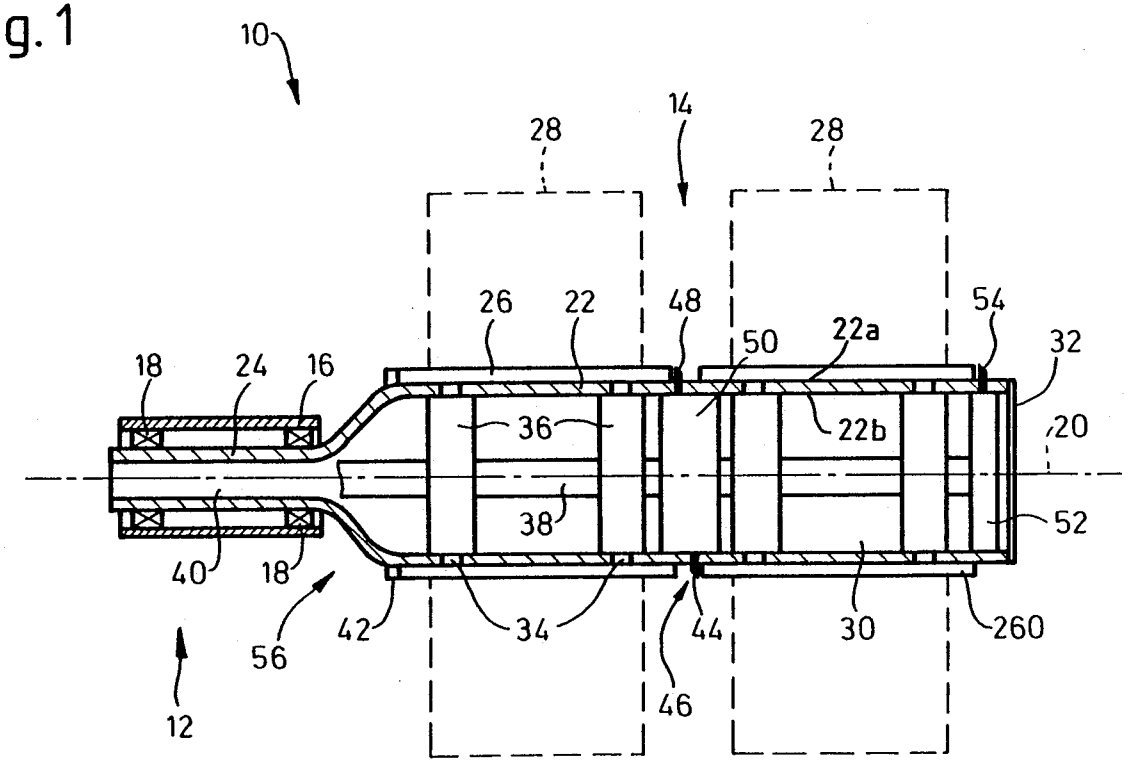
FIG. 1 is a longitudinal section of a chuck according to a first embodiment of the invention.

Turning now specifically to FIG. 1 of the drawings, the apparatus illustrated therein by way of example and not limitation will be seen to comprise a chuck 10 comprising a bearing portion 12 and a cantilever or axially projecting portion 14. The bearing portion 12 comprises a stationary casing or shell 16 enclosing bearings 18 defining an axis of rotation 20.

The rotational structure of the chuck 10 comprises a single, integral load-bearing element which is made up of a first tubular portion 22 in the cantilever or axially projecting portion 14, and a second tubular portion 24 extending from the first tubular portion 22 into the bearing portion 12 to be supported and journalled therein by the bearings 18.

The outer surface **22*a* of the first tubular portion 22 is substantially cylindrical and the diameter of the cross section is such that the chuck 10 can receive and support bobbin tubes such as those designated by the reference numerals 26 (inboard bobbin tube) and 260 (outboard bobbin tube). These inboard and outboard bobbin tubes 26 and 260 are normally specified by the end user of the machines. They should be mounted with a smooth sliding fit on the cylindrical outer surface 22*a* of the first tubular portion 22 so as to enable interference-free donning of inboard and outboard bobbin tubes 26 and 260 and doffing of completed packages or thread packages 28** formed thereon as indicated in dotted lines.

For convenience of illustration and description of the principles involved, all figures of the drawings show or refer to a chuck 10 designed to carry two bobbin tubes in operation, namely the inboard bobbin tube 26 and the outboard bobbin tube 260, for winding two packages from two delivered threads. The chuck 10 is designed to be cantilever-mounted and the inboard and outboard bobbin tubes 26 and 260 are "donned" by moving them axially along the chuck 10 from the free or outer end thereof. When the chuck 10 is ready for use, therefore, it carries an "inboard" bobbin tube 26 (near the chuck support) or bearing portion and an "outboard" bobbin tube 260 (near the free end of the chuck). The invention is not limited to use with only two bobbin tubes. It will be understood that, except where specifically indicated to the contrary, all of the features described hereinbelow in relation to a "two-bobbin" chuck are also applicable without alteration in relation to a chuck carrying more than two bobbin tubes. The expressions "upper" and "lower" are used hereinafter in the description of the drawings; it will be understood that these expressions apply merely to the dispositions of the parts as they happen to be illustrated in the Figures and have no significance in relation to the actual operation of the illustrated parts.

The hollow interior of the first tubular portion 22 defines a chamber 30 extending axially over almost the whole length of the first tubular portion 22 and opening at the free or outer end of the chuck 10. The chamber 30 is closed in use by a cap 32 secured to the first tubular portion 22 by any suitable means, such as fixing screws 110 (cf. FIG. 5). Mounted within the chamber 30 are devices for securing and centering each bobbin tube 26 and 260 relative to the first tubular portion 22 for rotation therewith about the axis of rotation 20. These devices have been indicated only in block diagrammatic form in FIG. 1; suitable embodiments of such devices will be described later with reference to subsequent Figures, and further devices are already known in the filament winding art.

Considering the inboard device (that is, the device nearest the bearing portion 12) merely by way of example, this device comprises a plurality of bobbin tube-engaging elements 34 passing through respective therewith associated openings or apertures 72 (cf. FIG. 4) in the first tubular portion 22. These openings 72 are equiangularly spaced around the axis of rotation 20. There may be, for example, six or eight such openings 72 with a corresponding number of bobbin tube-engaging elements 34. The bobbin tube-engaging elements 34 are movable radially between radially inward (retracted) positions in which they do not interfere with doffing and donning of inboard and outboard bobbin tubes 26 and 260, and radially outward (extended) positions in which they secure the respective inboard or outboard bobbin tube 26 or 260 relative to the first tubular portion 22.

For each inboard and outboard bobbin tube 26 and 260, there are two sets of bobbin tube-engaging elements 34 located adjacent the inboard and outboard ends respectively of the associated inboard or outboard bobbin tube 26 or 260 when the latter are correctly axially located relative to the first tubular portion 22. For each set of bobbin tube-engaging elements 34, there is a respective moving means, such as the inboard moving or actuating means 36. Each moving means 36 is operable to move the bobbin tube-engaging elements 34 of its respective set from the retracted position to the extended position, and to enable return of the bobbin tube-engaging elements 34 to the retracted position. The moving means 36 are selectively operable by an energizing means 38 extending axially along the central portion of the chamber 30. A suitable form of energizing means 38 will be disclosed in more detail hereinafter with reference to FIG. 4. Communication with the energizing means 38 can be established via a passage or bore 40 extending axially of the second tubular portion 24.

Correct axial location of the inboard bobbin tube 26 relative to the first tubular portion 22 is assured by an axial abutment or end stop 42 adjacent the inboard end of the first tubular portion 22. The inboard bobbin tube 26 can be pushed along the first tubular portion 22 into engagement with the axial abutment or end stop 42. Correct location of the outboard bobbin tube 260 is ensured by a locating element 44 which is caused to project through a suitable opening in the first tubular portion 22 after donning of the inboard bobbin tube 26. When moved to its extended position, the locating element 44 acts as an abutment limiting movement of the outboard bobbin tube 260 towards the inboard end of the first tubular portion 22.

As illustrated in FIG. 1, the arrangement is such that an axial gap 46 is left between the adjacent ends of correctly located inboard and outboard bobbin tubes 26 and 260. A thread catching and severing element 48 can be caused to move into this axial gap 46 after donning of the inboard and outboard bobbin tubes 26 and 260. The locating element 44 and the thread catching and severing element 48 are carried by a common support ring 50 within the first tubular portion 22. A suitable form of support ring 50 will be described hereinbelow.

A support ring 52 similar to the support ring 50 is provided adjacent the outboard end of the outboard bobbin tube 260. However, the support ring 52 carries only thread catching and severing elements 54, since the outboard bobbin tube 260 is axially located at the inboard end thereof by the locating element 44.

The various components disposed within the first tubular portion 22 are assembled therewith by insertion through the open, free end of the first tubular portion 22, which is thereafter closed by the cap 32.

Before turning to details of practical embodiments based upon the principles illustrated in FIG. 1, attention is drawn to the following features:

The first tubular portion 22 is of constant wall thickness or cross-section over substantially its whole length, that is, the chamber 30 is of constant cross-section up to a position close to or beyond the inboard end of the inboard bobbin tube 26;

The load-bearing element, i.e. the first tubular portion 22, in the cantilevered, rotational structure also provides the casing or shell for that structure; and The cantilever portion 14 and the bearing portion 12 of the rotational structure are structurally united by the integral tapered transition or junction portion generally designated by the reference numeral 56 in FIG. 1.

Figure 2:
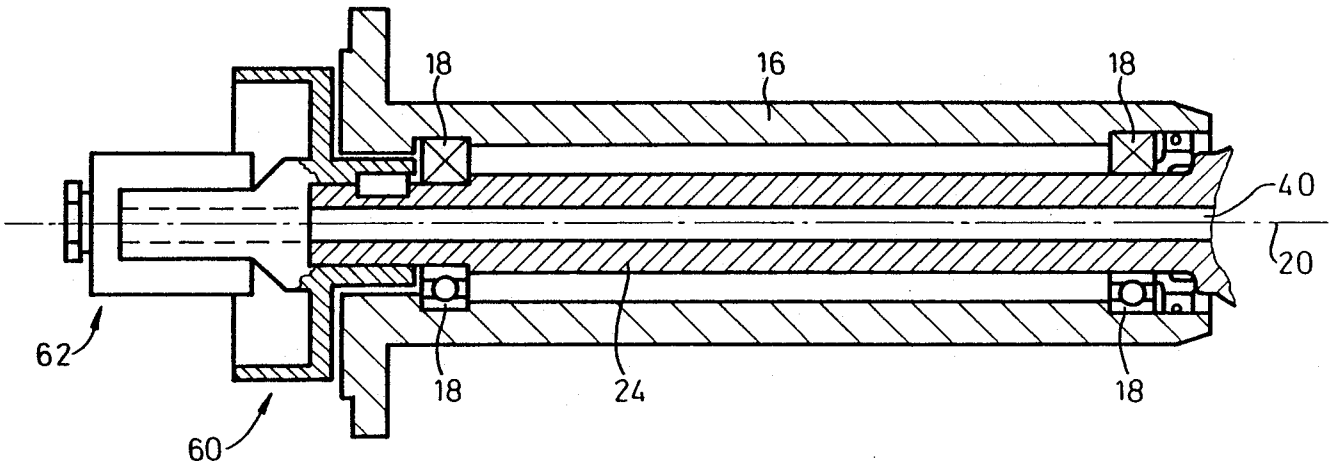
FIG. 2 is a longitudinal section of the bearing part of a chuck according to FIG. 1.

FIG. 2 shows the bearing portion 12 of a practical embodiment of a chuck 10 designed on the principles described with reference to FIG. 1 but with additional detail. The support casing or shell is again indicated by the reference numeral 16 and the bearings by the reference numeral 18. The smaller diameter portion of the rotating structure is again the second tubular portion 24 with the passage or axial bore 40 therein.

A braking and driving unit 60 is secured to the second tubular portion 24 at an end thereof remote from the first tubular portion 22. This braking and driving unit 60 is conventional and will not be described in more detail. The braking and driving unit 60 also provides a coupling 62 by means of which a fluid pressure medium can be supplied to the interior of the passage or bore 40 in operation. The purpose of this fluid pressure medium will become apparent from the description of FIG. 4 below.

Figure 3:
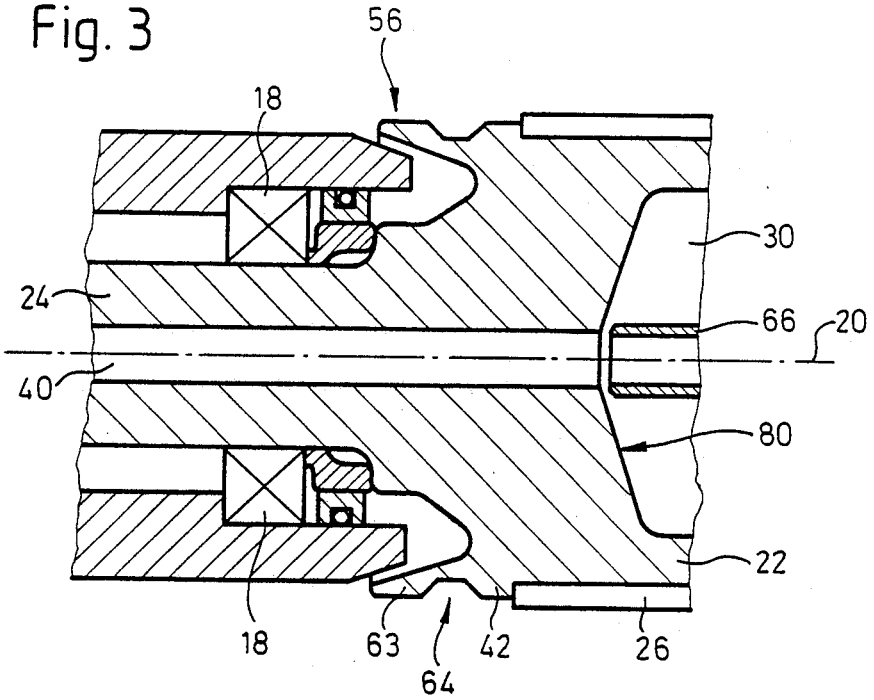
FIG. 3 is a longitudinal section of the junction region between the bearing part shown in FIG. 2 and a cantilever part shown in FIG. 4.

FIG. 3 shows the integral junction portion or region 56 in greater detail. In particular, FIG. 3 shows that the inboard end of the chamber 30 can extend very close to the outboard bearing 18. A suitable taper is provided between the external diameter or surface 22*a* of the first tubular portion 22 (determined by the inboard and outboard bobbin tubes 26 and 260) and the external diameter of the second tubular portion 24 (determined by the structure of the bearing portion 12). The axial abutment or end stop 42 forms a projection on this taper and, in this embodiment, adjoins an additional projection 63 enabling provision of a thread-catching groove 64. In the event that a thread winding should pass beyond the inboard end of the inboard bobbin tube 26, it will be retained within the thread-catching groove 64.

As also shown in FIG. 3, the outer end of the passage 40 adjoins the inner end of a common fluid pressure medium supply conduit or tube 66 which extends axially along the central portion of the chamber 30. The purpose of this common fluid pressure medium supply conduit or tube 66 will be further explained in the course of the description of FIG. 4. Briefly, it provides the energizing means referred to above in connection with FIG. 1.

Figure 4:
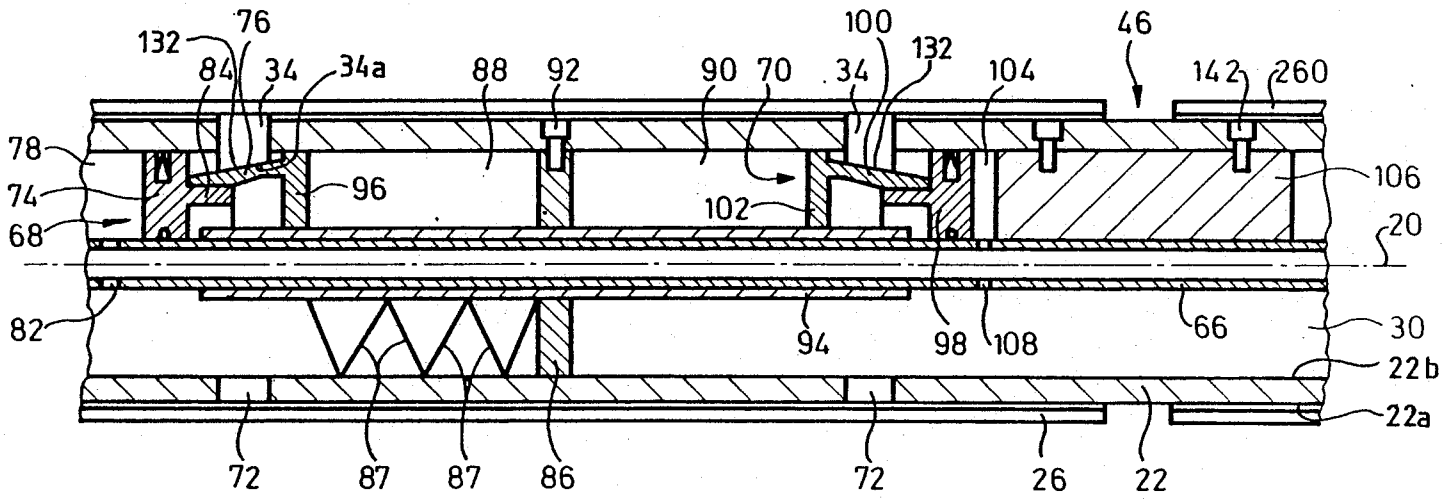
FIG. 4 is a longitudinal section of a part of the chuck containing bobbin tube-engaging, elements i.e. gripping and locating elements.

FIG. 4 shows the greater part of the inboard bobbin tube 26 and the adjoining end of the outboard bobbin tube 260, each being correctly axially located relative to the first tubular portion 22. For the sake of simplicity, details have been omitted from the lower half thereof. The lower half of FIG. 4 is in fact a mirror-image of the upper half, the chuck 10 being symmetrical about its central axis of rotation 20. The inboard bobbin tube 26 (on the left in FIG. 4) will be considered first and in particular the devices within the chamber 30 adapted to cooperate with the inboard bobbin tube 26.

Bobbin tube gripping system

One important function of the devices to be described is securing of the inboard bobbin tube 26 to the first tubular portion 22 for rotation therewith about the axis of rotation 20. It is important that the inboard bobbin tube 26 and any thread package 28 (FIG. 1) carried thereby, be secured against any movement relative to the chuck 10 during rotation about the axis of rotation 20. In particular, the systems to be described must prevent not only relative axial and circumferential movement between the thread package 28 and the chuck 10, but also relative radial movement thereof. The latter can be caused, for example, if the devices in contact with the inboard bobbin tube 26 are not positively centered relative to the first tubular portion 22. If that happens, imbalance can arise in the system and can lead to severe damage at the very high rotational speeds prevailing.

The bobbin tube-engaging elements 34 referred to in the description of FIG. 1 are shown again in FIG. 4. There are two sets of bobbin tube-engaging elements 34 (inboard and outboard) for each bobbin tube 26 and 260. The bobbin tube-engaging elements 34 of each set are equally spaced angularly around the axis of rotation 20, being located in respective openings or apertures 72 indicated in the lower half of FIG. 4. The moving means 36 referred to in the description of FIG. 1 comprise, in the embodiment of FIG. 4, an inboard moving device 68 and an outboard moving device 70 which is similar but inverted relative to the inboard moving device 68. The latter will be described first.

The inboard moving device 68 comprises a piston element 74 and a wedging or ramping cone or camming member 76. The piston element 74 is an annulus. At its outer edge or circumference it is a smooth sliding fit in the cylindrical internal surface or bore 22*b* of the first tubular portion 22. At its inner edge or bore, it is a smooth sliding fit on the external cylindrical surface of the tube 66 previously referred to in the description of FIG. 3. The piston element 74 therefore defines or delimits a pressurizable compartment 78 between itself and an axially confronting end surface 80 (FIG. 3) of the chamber 30. The pressurizable compartment 78 can be pressurized through the slight gap between the inboard end of the tube 66 and the outboard end of the passage 40 (FIGS. 2 and 3) and also via radial openings 82 in the portion of the tube 66 lying within the pressurizable compartment 78. When the pressurizable compartment 78 is pressurized with an adequate pressure, the piston element 74 is moved to the right as viewed in FIG. 4.

The wedging cone or member 76 is a hollow, frustoconical body, the smaller diameter end of which is mounted on an axial projection 84 which is integral with the piston element 74. An outwardly facing conical surface 132 of the wedging cone or ramping element 76 extends axially across the circumferential array of openings 72, and is engaged by the radially inner ends 34*a* of each of the bobbin tube-engaging elements 34. As clearly seen in FIG. 4, the radially inner ends 34*a* of the bobbin tube-engaging elements 34 are suitably profiled to enable them to slide smoothly on the wedging cone 76. As the wedging cone 76 is moved to the left as viewed in FIG. 4, the bobbin tube-engaging elements 34 of the inboard moving device 68 are forced outwardly to engage and grip the inboard bobbin tube 26. As the wedging cone 76 is moved to the right as viewed in FIG. 4, the bobbin tube-engaging elements 34 are permitted to retract radially inwardly to release the inboard bobbin tube 26. As already described, the latter movement can be caused by pressurizing the pressurizable compartment 78. Normally, however, as will now be described, the inboard moving device 68 is biased toward the left as viewed in FIG. 4, so that the bobbin tube-engaging elements 34 are normally forced to their extended position. As will be described in reference to FIGS. 6, 7 and 8, each bobbin tube-engaging element 34 has a suitable retaining means (not shown in FIG. 4) to ensure that the bobbin tube-engaging element 34 is retained within the chuck structure when the inboard moving device 68 is forced to its full leftward (i.e. inboard) position in the absence of an inboard bobbin tube 26.

The space between the inboard and outboard moving devices 68 and 70 is divided by an intermediate bulkhead 86 into two compartments, an inboard compartment 88 and an outboard compartment 90. The intermediate bulkhead 86 is secured against axial movement relative to the first tubular portion 22 by fixing screws 92 passing through suitable bores in the first tubular portion 22. The intermediate bulkhead 86 is also annular, and carries at its inner edge or bore, a tube or sleeve 94 closely encircling the tube 66 and extending in both axial directions from the intermediate bulkhead 86 into both the inboard moving device 68 and the outboard moving device 70. The inboard end of the tube or sleeve 94 provides an end stop for the rightward movement of the piston element 74.

The inboard end of the inboard compartment 88 is defined or delimited by an annular wall 96 integral with the wedging cone 76. The outer edge or circumference of the annular wall 96 is a smooth sliding fit in the internal surface 22*b* of the first tubular portion 22 and the inner edge or bore of the annular wall 96 is a smooth sliding fit on the external surface of the tube or sleeve 94. The inboard compartment 88 contains a biasing means adapted to generate a force urging the inboard moving device 68 to the left as viewed in FIG. 4. The biasing force is preferably generated mechanically. Various mechanical devices using springs have already been proposed for this purpose and one such arrangement is indicated very diagrammatically in the lower half of FIG. 4 in the form of six ring elements 87, such as Belleville washers, arranged in mutual axial adjacency in the inboard compartment 88 and in contact at their inner and outer edges. In practice, many more than six ring elements 87 would be provided.

The group of ring elements 87 is axially compressible in the axial direction and the group of ring elements 87 is in a state of compression at all times within the assembled chuck structure, where they are confined between the bulkhead 86 and the annular wall 96. Expansion of the inboard compartment 88 and consequent relaxation of the group of ring elements 87 is limited by the means limiting radially outward movement of bobbin tube-engaging or gripping elements 34.

It is an important feature of the illustrated chuck structure or chuck 10 that all elements thereof are securely centered relative to the axis of rotation 20 in order to avoid imbalance in operation. In the case of the ring elements 87, such centering can be obtained either by secure contact of each ring element 87 at its inner edge with the tube or sleeve 94, or secure contact of each ring element 87 at its outer edge with the internal surface 22*b* of the first tubular portion 22. In this context, "secure contact" means that contact is established and maintained over a sufficient proportion of the periphery (either internal or external) of the ring element 87 to ensure that the ring element 87 is centered relative to the axis of rotation 20. Since play is normally required to enable assembly of the ring elements 87, each ring element 87 should be deformable in response to any axial compression load supplied thereto to ensure that the required secure contact is achieved after assembly is complete. An alternative, preferred biasing means, will be referred to hereinbelow.

The outboard moving device 70 is similar in structure to the inboard moving device 68 and will be described relatively briefly. It comprises a piston element 98, a wedging cone 100 and an annular end wall 102 slidable between the first tubular portion 22 and the tube or sleeve 94. In the outboard moving device 70, however, the piston element 98 is at the outboard end of the device, and the annular end wall 102 at the inboard end, adjoining the outboard compartment 90 which contains a non-illustrated mechanical biasing means similar to the biasing means described in relation to the inboard compartment 88.

A pressurizable compartment 104 is defined or delimited between the piston element 98 and a support unit 106, (equivalent to the support ring 50 in FIG. 1), the structure and purpose of which will be described later with reference to FIG. 10. Radial openings 108 in the common fluid pressure medium supply conduit or tube 66 enable supply of fluid pressure medium from the common fluid pressure medium supply conduit or tube 66 to the pressurizable compartment 104 in order to move the piston element 98 to the left as viewed in FIG. 4 until it engages an end stop provided by the tube or sleeve 94. Such movement of the piston element 98, and hence of the wedging cone 100, enables the bobbin tube-engaging elements 34 of the outboard moving device 70 to move radially inwards in their respective openings 72 and thereby release the outboard bobbin tube 260.

The inboard and outboard moving devices 68 and 70 are operated simultaneously by application of pressure to the passage 40 (FIG. 2) and hence to the common fluid pressure medium supply conduit or tube 66. However, the movements of the inboard and outboard moving devices 68 and 70 are independent of each other. The common fluid pressure medium supply conduit or tube 66 does not form a connection for mechanically transmitting movement to or between the devices, but only a conduit for transmitting fluid pressure medium. The respective mechanical biasing means in the inboard and outboard compartments 88 and 90 are separated by the intermediate bulkhead 86 which is fixed relative to the second tubular portion 24. Accordingly, each set of bobbin tube-engaging elements 34 can be independently urged into contact with its respective end of the inboard or outboard bobbin tube 26 or 260 to be engaged or gripped. This enables independent adaptation of each set of bobbin tube-engaging elements 34 to varying bobbin tube tolerances encountered in practice.

For each inboard or outboard bobbin tube 26 or 260 carried by the chuck 10, there is an inboard moving device 68 and an outboard moving device 70, each with a respective set of bobbin tube-engaging elements 34 and each pressurizable via the common fluid pressure medium supply conduit or tube 66. For each pair of inboard and outboard moving devices 68 and 70 there is a respective intermediate bulkhead 86 separating the mechanical biasing means acting on the respective inboard and outboard moving devices 68 and 70. Where more than two bobbin tubes 26 and 260 are to be carried on the chuck 10, a support unit 106 is provided in the region bridging the adjacent ends of each successive pair of bobbin tubes 26, 260.

Figure 5:
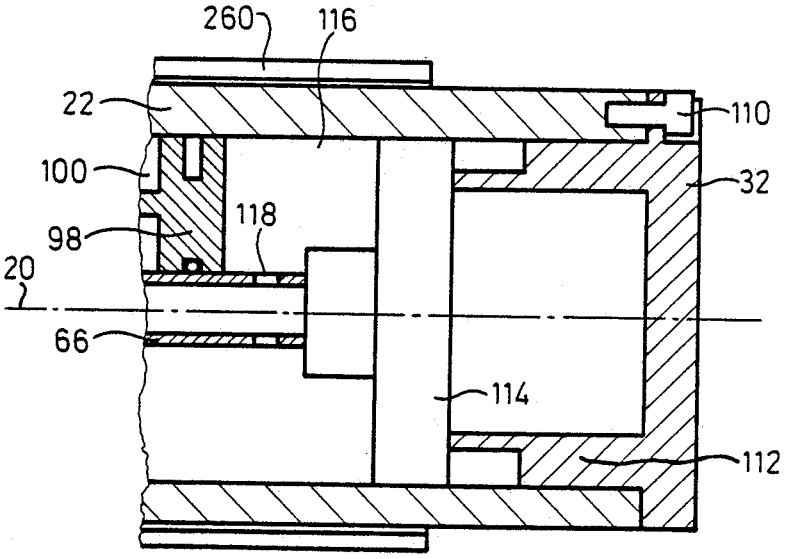
FIG. 5 is a longitudinal section of the free end , of the chuck shown in FIGS. 2, 3 and 4.

The arrangement at the outboard end of the chuck 10 will now be described with reference to FIG. 5. In FIG. 5, the open end of the first tubular portion 22 is shown, together !, with the closure cap 32 secured to the first tubular portion 22 by fixing screws 110. The cap 32 has an axial projection 112 extending into the open end of the first tubular portion 22 and locating a disc 114 at its inboard end (equivalent to the support ring 52 in FIG. 1), the structure and purpose of which will be described later within reference to FIG. 10. The outboard end of the common fluid pressure medium supply conduit or tube 66 engages the disc 114. A pressurizable compartment 116 is formed between the disc 114 and the piston element 98 of the outboard moving device 70, and this pressurizable compartment 116 can be pressurized via radial openings or apertures 118 in the common fluid pressure medium supply conduit or tube 66.

Each inboard and outboard bobbin tube 26 and 260 must be secured against axial and circumferential slippage relative to the second tubular portion 24, and also against radial play. Such radial play must be prevented between each bobbin tube-engaging or gripping element 34 and the confronting internal surface on the bobbin tube 26 or 260, and between the radially inner end **34*a* of the bobbin tube-engaging element 34 and the respective associated wedging cone 76 or 100. It is tube-engaging element 34 be positively urged outwardly by its associated wedging cone 76 or 100. In this connection, centrifugal force acting on the bobbin tube-engaging element 34 at high rotational speeds represents a problem, since it tends to urge each bobbin tube-engaging element 34 outwardly away from its associated wedging cone 76 or 100. This increases the axial and circumferential gripping effect of the bobbin tube-engaging element 34 on the associated bobbin tube 26 or 260, but reduces the centering effect. Accordingly, if the bobbin tube-engaging elements 34 in any one set thereof are no longer positively centered relative to the axis of rotation 20, and significant imbalance arises in the system during formation of a thread package 28, then the resulting vibrations can cause serious damage to the chuck 10** and, possibly, to the machine as a whole.

Figure 6:
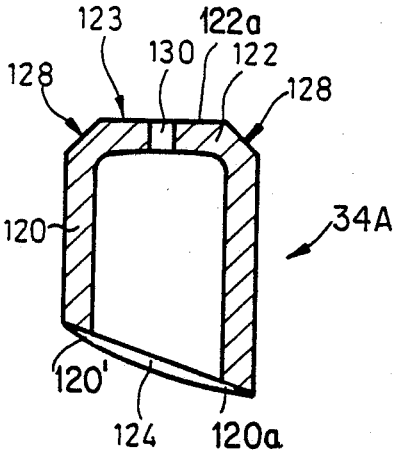
FIG. 6 is a section of a bobbin tube-engaging element suitable for use in a system as shown in FIG. 4.
Figure 7:
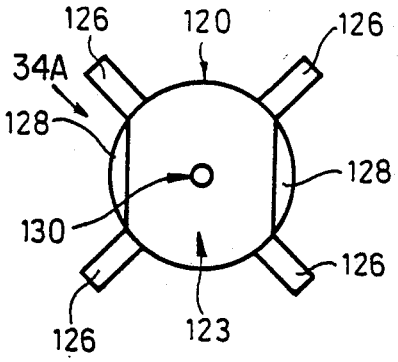
FIG. 7 is a plan view of the bobbin tube-engaging element shown in FIG. 6.
Figure 8:
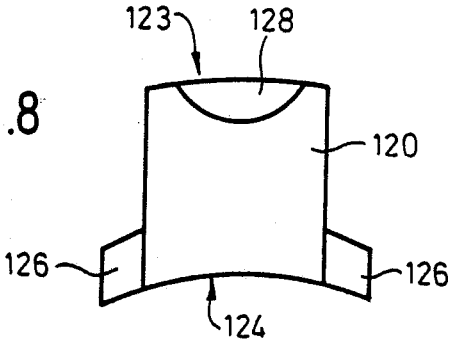
FIG. 8 is a front elevation of the bobbin tube-engaging element shown in FIGS. 6 and 7.

The centrifugal force acting on any one bobbin tube-engaging element 34 is a function of the mass of that bobbin tube-engaging element 34. FIGS. 6, 7 and 8 show a design of bobbin tube-engaging element 34A of a relatively low mass compared with that of those currently in use so that there is less tendency for centrifugal force to create radial play between the radially inner end **34*a* of such bobbin tube-engaging elements 34A and the respective wedging cone 76 or 100. These bobbin tube-engaging elements 34A each comprise a columnar or hollow cylindrical body portion 120 having a closed end 122 providing a bobbin tube-engaging head portion 122*a* and an open end 120' providing a cone-engaging foot portion 120*a*. A generally axially confronting surface 124 at the open end 120' of the columnar or hollow cylindrical body portion 120 is shaped, as seen in FIG. 6 and FIG. 8, to conform to the corresponding frustoconical surface 132 of its associated wedging cone 76 or 100. Preferably, the wedging cones 76 and 100 each have the same shape, so that all bobbin tube-engaging elements 34A** can be substantially identical.

The bobbin tube-engaging head portion **122*a* has an outwardly facing surface 123 which, as seen in FIG. 8, is convex as viewed axially of the chuck 10. The curvature corresponds to that of the internal surface of the inboard or outboard bobbin tube 26 or 260. The outwardly facing surface 123** has an area which will be discussed in more detail hereinbelow.

Four outwardly extending projections or legs 126 (FIGS. 7 and 8) are provided at the foot portion **120*a* of each bobbin tube-engaging element 34A. These outwardly extending projections or legs 126 act as retainers, preventing the related bobbin tube-engaging element 34A from escaping from its respective opening 72 (FIG. 4) in the first tubular portion 22. Furthermore, a radially inwardly facing surface is formed on each outwardly extending projection or leg 126, as can be seen in FIG. 8, to engage and slide upon the associated wedging cone 76 or 100. The bobbin tube-engaging head portion 122 is provided with two straight chamfers 128 facing in opposite directions relative to the chuck 10, and with an end opening or orifice 130** permitting exit of air from the hollow interior.

Each bobbin tube-engaging element 34A is made in one piece of a plastics material, for example polyacetal or polyoxymethylene (POM). This material is of low density in comparison to metal. Furthermore, the hollow structure of each bobbin tube-engaging element 34A reduces the mass thereof, so that there is less tendency for centrifugal force to separate the generally axially confronting surface 124 from the corresponding wedging cone 76 or 100. Nevertheless, the columnar or hollow cylindrical body portion 120 provides adequate compression strength to resist the forces applied axially thereto in firmly gripping the bobbin tubes 26 and 260. The bobbin tube-engaging head portion 122 provides an adequate zone of contact with the internal surface of the inboard or outboard bobbin tube 26 or 260, enabling firm gripping thereof without causing undue bobbin tube damage by forcing the gripping elements into the wall of the inboard and outboard bobbin tubes 26 and 260 used therewith.

Figure 9:
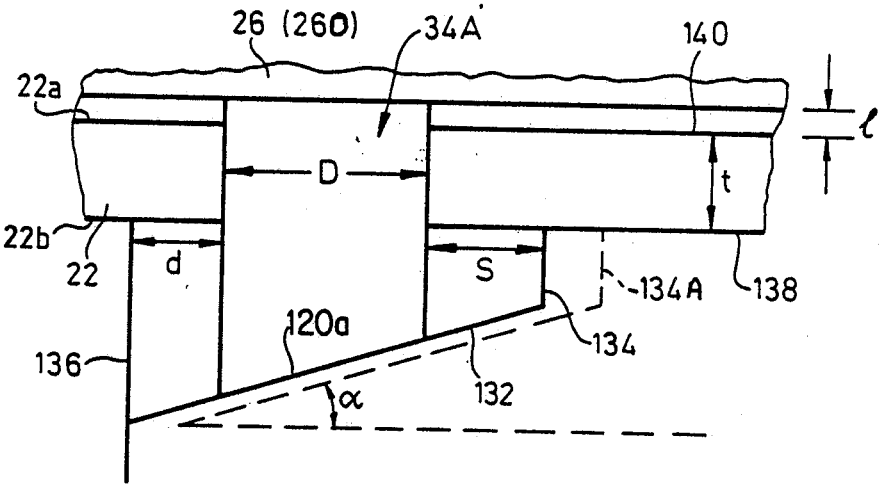
FIG. 9 is a diagrammatic side elevation showing the combination of a bobbin tube-engaging element as illustrated in FIGS. 6, 7 and 8 with an operating system, i.e. bobbin tube-engaging system, as shown in FIG. 4.

By way of example only, FIG. 9 diagrammatically shows a system using bobbin tube-engaging elements 34A suitable for gripping an inboard or outboard bobbin tube 26 or 260 of a nominal internal diameter of 75 mm. In FIG. 9, the bobbin tube-engaging element 34A is shown engaging the internal surface of an inboard bobbin tube 26 having exactly the nominal diameter of 75 mm. The foot portion 120*a* of the bobbin tube-engaging element 34A is in firm engagement with the wedging or conical surface 132 of the corresponding wedging cone 76 or 100. The wedging angle of the wedging or conical surface 132 is designated by the reference character $\alpha$ in FIG. 9. This is the angle between an imaginary line defined by the intersection of an axial plane with the wedging or conical surface 132 and a line in the same plane parallel to the axis of rotation of the wedging cone 76 or 100, i.e., the demi-angle of the corresponding cone. The angle $\alpha$ may, for instance, be about 42°.

The line 134 in FIG. 9 represents an axially confronting surface on the annular wall 96 or the annular end wall 102 (FIG. 4) of the associated inboard or outboard moving device 68 or 70. The line 136 represents an axial surface, confronting the axially confronting surface 134, on the corresponding piston element 74 or 98 (FIG. 4). The external diameter of the bobbin tube-engaging element 34A in a plane at right angles to the axis of rotation of the columnar or hollow cylindrical body portion 120 (FIG. 6) is designated by the reference character D in FIG. 9, the spacing of the columnar or hollow cylindrical body portion 120 from the axial surface 134 is designated by the reference character s and the spacing of the columnar or hollow cylindrical body portion 120 from the axially confronting surface 136 is designated by the reference character d. The external diameter D may be approximately 12 mm, and when the bobbin tube-engaging element 34A is in its normal extended position (as illustrated, in contact with the internal surface of a bobbin tube 26 or 260 of the specified internal diameter), the spacing s may be approximately 4 mm and the spacing d may be approximately 5 mm. The non-indicated internal diameter of the columnar or hollow cylindrical body portion 120 in a plane corresponding to the external diameter D may be approximately 8 to 10 mm.

A resultant area A of the outwardly facing surface 123 is approximately 100 $mm^2$, but areas A in the range 80 to 120 $mm^2$ are suitable.

The line 138 in FIG. 9 represents the intersection of the axial plane referred to above with the internal surface 22*b* of the first tubular portion 22 (FIG. 4) and the line 140 represents the intersection of the same axial plane with the external surface 22*a* of the first tubular portion 22. The wall thickness of the first tubular portion 22 is therefore t in FIG. 9 and may be approximately 8 mm for a steel tube. The radial spacing between the external surface 22*a* of the first tubular portion 22 and the internal surface of the bobbin tube 26 or 260 is designated by the reference character l in FIG. 9, and may be approximately 1 mm for an inboard or outboard bobbin tube 26 or 260 having the nominal internal diameter and at a maximum may be 1.7 mm. Such a chuck 10 can be driven in operation at speeds up to about 24,000 RPM.

Bobbin tube positioning

As shown in FIG. 4, and as already described in relation to FIG. 1, an axial gap 46 is provided between the adjacent ends of the axially successive inboard and outboard bobbin tubes 26 and 260. As can also be seen in FIG. 4, the axial gap 46 is bridged within the first tubular portion 22 by the support unit or ring 106 referred to very briefly above. This support ring 106 is fixed axially relative to the first tubular portion 22 by fixing screws 142. The support ring 106 carries at least one positioning element adapted to act as an axial stop for the inboard end of the outboard bobbin tube 260. The principle of such a positioning element is shown in the aforementioned U.S. Pat. No. 4,056,237, and such a positioning element could be used in the support ring 106 if suitable openings were provided in the first tubular portion 22. However, a preferred form of positioning element is shown in FIG. 10 and will now be described.

Figure 10:
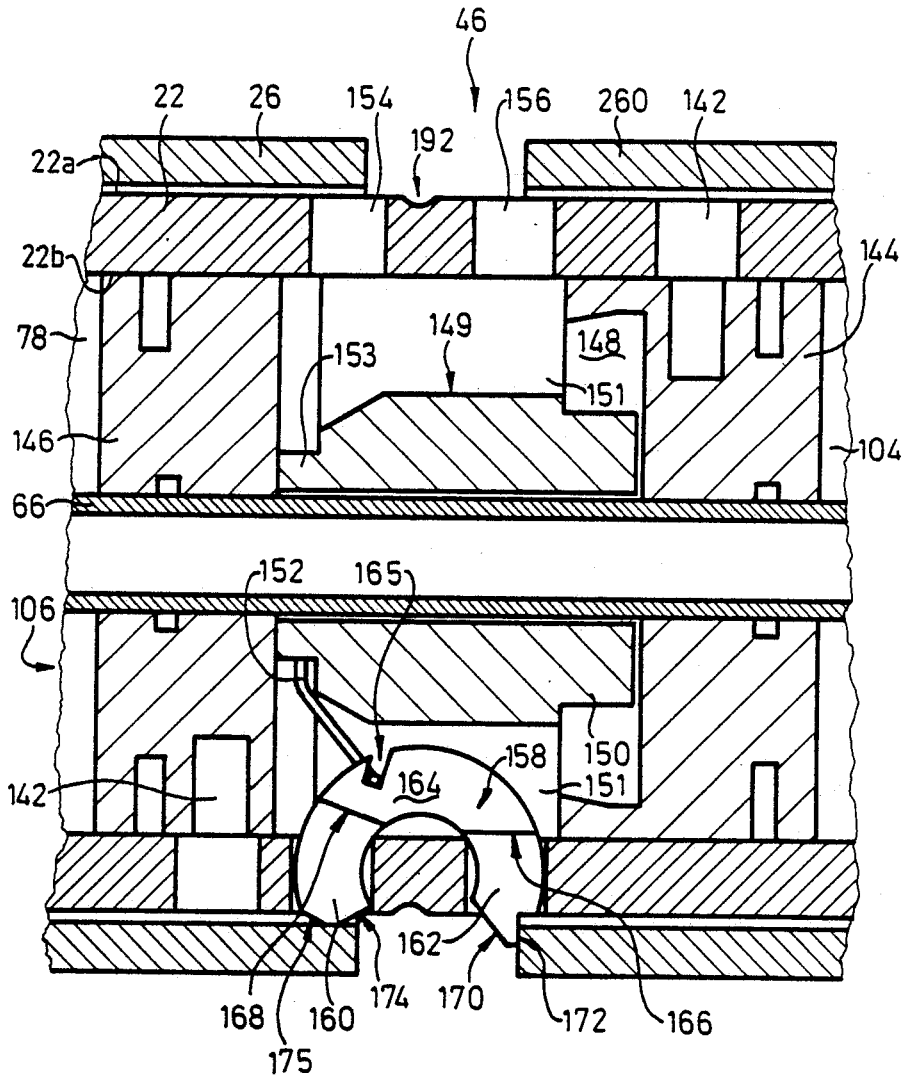
FIG. 10 is a sectional diagram on an enlarged scale and showing additional details of part of FIG. 4.

FIG. 10 shows the support ring or unit 106 drawn on an enlarged scale to show internal details thereof. The support ring or unit 106 comprises a pair of annular bulkheads 144 and 146 respectively, fixed to the first tubular portion 22 by the fixing screws 142 referred to above. Each of these annular bulkheads 144 and 146 is sealed at its outer edge or circumference to the first tubular portion 22 and at its inner edge or circumference to the common fluid pressure medium supply conduit or tube 66 so as to define or delimit a compartment 148 which is isolated from the fluid pressure medium in the pressurizable compartments 78 and 104 on either side of the support ring or unit 106. A support ring 150 is mounted on the common fluid pressure medium supply conduit or tube 66 within the compartment 148. The support ring 150 has two radial slots 151 diametrically opposite each other and opening onto the circumference of the support ring 150. A central end projection 153 on the support ring 150 carries a pair of arms or spring arms 152 extending into the respective radial slots 151, only the lower arm or spring of the pair of arms or springs 152 being illustrated in FIG. 10. The purpose of these arms or springs will be explained below.

The first tubular portion 22 has two pairs of radial or openings, one pair of radial or openings designated by the reference numerals 154 and 156 in FIG. 10 opening into one of the radial slots 151, and the other pair (not shown in FIG. 10 but situated diametrally opposite to the first pair 154, 156) opening into the other radial slot 151. Each radial slot 151 contains a semi-circular positioning element 158, only the lower semi-circular positioning element 158 being visible in FIG. 10. The semi-circular positioning element 158 is generally equivalent to the locating element 44 in FIG. 1.

Each semi-circular positioning element 158 comprises a first arm 160 located in the associated radial bore or opening 154 and a second arm 162 located in the associated radial bore or opening 156. The first and second arms 161 an 162 are joined by a connecting portion 164 within the compartment 148. The detailed construction of the semi-circular positioning elements 158 will be described below in relation to FIG. 11. It will be seen from FIG. 10, however, that the connecting portion 164 has a slot 165 for receiving a transverse bar or leg on the associated arm or spring of the pair of arms or springs 152. The arm or spring of the pair of arms or springs 152 is effective for urging the semi-circular positioning element 158 radially outwardly so that its first and second arms 160 and 162 are retained in the respective associated radial bores 154 and 156. Simultaneously, the arm or spring of the pair of arms or springs 152 tends to rotate the associated semi-circular positioning element 158 about an imaginary or virtual center of rotation in a direction urging the free end of the first arm 160 outwardly from the first tubular portion 22, that is, for the semi-circular positioning element 158 actually illustrated in FIG. 10, in a counterclockwise direction about its imaginary or virtual center of rotation.

The connecting portion 164 is seen in section in FIG. 11 together with the second arm 162. The connecting portion 164 is of substantially rectangular cross section, while the second arm 162 is of substantially circular cross section, the transverse dimension of the second arm 162 being less than that of the connecting portion 164 so that a shoulder 166 is formed at the junction of the second arm 162 with the connecting portion 164. A similar shoulder 168, indicated diagrammatically in FIG. 10, is formed at the junction of the first arm 160 with the connecting portion 164.

At its free end, the second arm 162 has a chamfer 170 and a stop surface 172 (cf. FIG. 10) which is oriented to face axially of the chuck 10 when the semi-circular positioning element 158 is in the position shown in FIG. 10. As will be described later, the stop surface 172 provides a tube stop. As seen in FIG. 10, the free end of the first arm 160 has oppositely facing chamfered surfaces 174 and 175. The surface 174 generally faces the chamfer 170.

The radial bores 154 and 156 are dimensioned to receive the respective first and second arms 160 and 162 but not the connecting portion 164. Accordingly, when appropriate forces are applied, each semi-circular positioning element 158 can be rotated about its imaginary or virtual center of rotation until either the shoulder 166 (FIG. 11) or the similar shoulder 168 (FIG. 10) engages the internal surface 22*b* of the first tubular portion 22 adjacent the respective radial bore 154 or 156. When the shoulder 166 engages the first tubular portion 22 as shown in FIG. 10, the stop surface 172 faces generally axially of the chuck and projects from the radial bore 156 so as to provide an end stop for engagement by the outboard bobbin tube 260. When the similar shoulder 168 engages the first tubular portion 22, the second arm 162 lies wholly within the external surface 22*a* of the first tubular portion 22, and does not interfere with axial movement of the bobbin tubes 26 or 260.

As will now be described in relation to FIGS. 12*a* to 12*f*, each arm or spring of the pair of arms or springs 152 urges its associated semi-circular positioning element 158 towards a predetermined "starting" position, but the semi-circular positioning element 158 can be forced away from this starting position and into a series of further possible positions by simple axial movement of the inboard and outboard bobbin tubes 26 and 260 along the chuck 10. FIGS. 12*a* to 12*f* are in the form of a series of diagrams representing the various positions of the upper semi-circular positioning element 158, the starting position being shown in FIG. 12*a*.

In the starting position, the chuck 10 is assumed to be at rest and does not carry any inboard or outboard bobbin tubes 26 or 260. The free end of the first arm 160 projects from the external surface 22*a* of the first tubular portion 22, with the surface 174 facing towards the free end of the chuck 10 (i.e. to the right as viewed in FIG. 12*a*). An outer curved surface of the first arm 160 contacts the surface or wall defining the radial bore 154 at a zone of contact 177 on the inboard side or wall of the radial bore 154. The second arm 162 lies within the external surface 22*a* of the first tubular portion 22, or at least is retracted so far into its radial bore 156 that it will not interfere with movement of the inboard bobbin tube 26 from right to left as indicated by the arrow. Accordingly, the end face on the inboard end of the bobbin tube . 26 will strike against the surface 174 and "wedge" the first arm 160 radially inwardly into its radial bore 154.

Figure 12A:
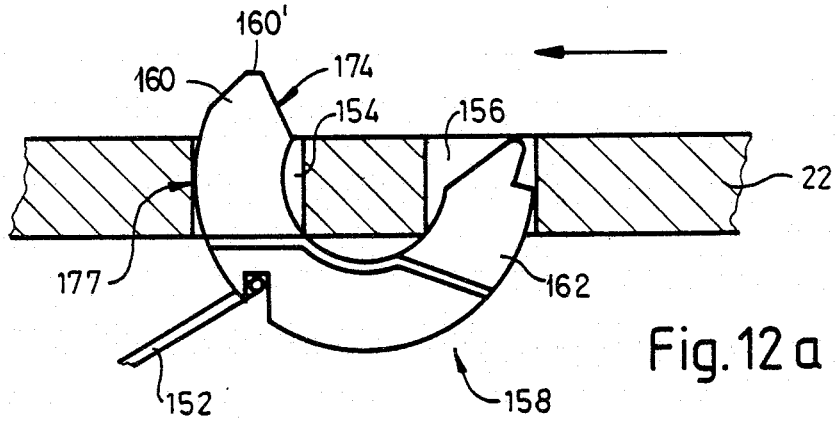
FIGS. 12*a*, 12*b*, 12*c*, 12*d*, 12*e* and 12*f* show a series of diagrams representing various positions of a part shown in FIGS. 10 and 11.
Figure 12B:
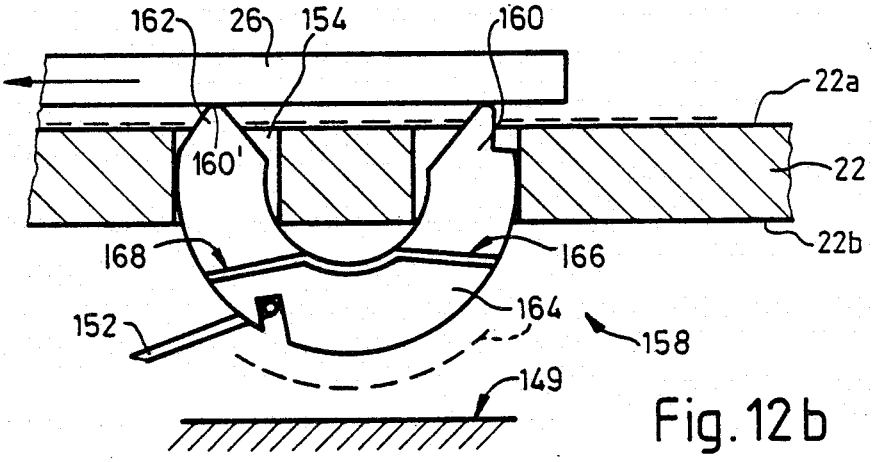
Figure 12C:
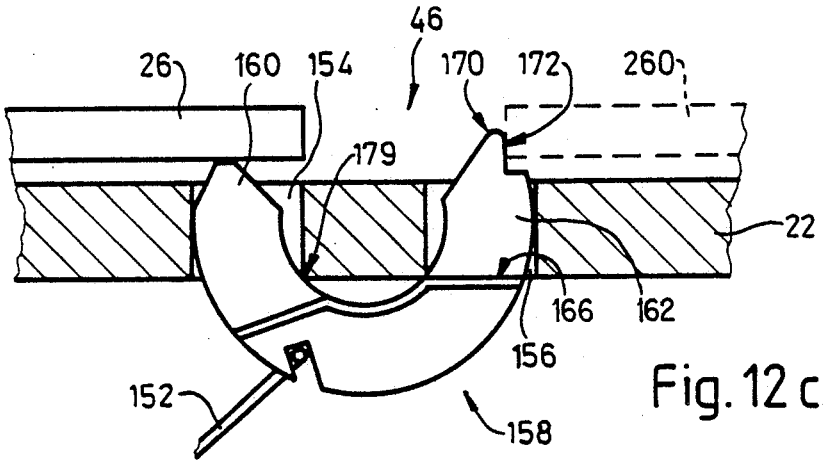

As movement of the inboard bobbin tube 26 to the left continues, a flat end surface 160′ on the first arm 160 passes into contact with the internal surface of the inboard bobbin tube 26 as shown in FIG. 12*b*. The arm or spring of the pair of arms or springs 152 meanwhile continues to urge the outer curved surface of the first arm 160 into contact with the inboard side of the radial bore 154. Both the shoulder 166 and the similar shoulder 168 are now spaced from the internal surface 22*b* of the first tubular portion 22, and the generally radially outward force applied by the arm or spring of the pair of arms or springs 152 urges the free end of the second arm 162 also into engagement with the internal surface of the inboard bobbin tube 26.

As soon as the outboard end of the inboard bobbin tube 26 moves to the left beyond the free end of the second arm 162, the arm or spring of the pair of arms or springs 152 urges the second arm 162 still further radially outwardly until the shoulder 166 comes into contact with the internal surface 22*b* of the first tubular portion 22. This is the position illustrated in FIG. 10, in which the stop surface 172 is disposed as an end stop for the axial end of the outboard bobbin tube 260 as also shown in dotted lines in FIG. 12*c*. It will be noted, however, that at all stages of these movements, the arm or spring of the pair of arms or springs 152 urges the semi-circular positioning element 158 in a generally inboard direction so that contact is maintained between the outer curved surface of the first arm 160 and the inboard side or wall of the radial bore 154. The zone of contact 177, of course, moves axially of the radial bore 154 and around the circumference of the semi-circular positioning element 158 as the semi-circular positioning element 158 moves, but contact is nevertheless maintained as a main guidance and location means for the semi-circular positioning element 158. In addition, in the state shown in FIG. 12*c*, contact will be made between an inner curved surface of the first arm 160 and the lower edge or wall portion of the radial bore 154 as indicated at 179.

Assuming that the inboard bobbin tube 26 is brought into contact with the axial abutment or end stop 42 (cf. FIG. 1) and the outboard bobbin tube 260 is correctly seated against the stop surface 172, then the axial gap 46 will be formed between the adjacent ends of the inboard and outboard bobbin tubes 26 and 260. This axial gap 46 will be of generally predetermined width, allowing for length tolerances on the inboard bobbin tube 26. The purpose of the axial gap 46 will be described later in relation to FIGS. 13 and 14. First, however, removal of the outboard and inboard bobbin tubes 260 and 26 from the chuck 10 will be described in relation to FIGS. 12*a* to 12*c*.

It will firstly be assumed that the outboard and inboard bobbin tubes 260 and 26 and the semi-circular chuck 10 without performance of a winding operation, that is, no thread packages 28 have been formed. At the start of the removal operation, the outboard and inboard bobbin tubes 260 and 26 and . the semi-circular positioning element 158 are in the positions shown in FIG. 12*c*. Removal of the outboard bobbin tube 260 has no effect upon the disposition of the semi-circular positioning element 158. When the inboard bobbin tube 26 is moved away from its axial abutment or end stop 42 (cf. FIG. 3) it will first strike against the chamber 170 on the second arm. Continued movement of the inboard bobbin tube 26 towards the free end of the chuck 10 will wedge the second arm 162 back into its radial bore 156 until the position shown in FIG. 12*b* is reestablished. Then, when the inboard end of the inboard bobbin tube 26 passes to the right (as viewed in FIG. 12*b*) beyond the free end of the first arm 160, the arm or spring of the pair of arms or springs 152 will return the semi-circular positioning element 158 to the disposition shown ., in FIG. 12*a*, whereupon the semi-circular positioning element 158 is ready for a repeat operation.

When packages 28 have been wound on the inboard bobbin tube 26 and the outboard bobbin tube 260, the situation differs only in that the outboard and inboard bobbin tubes 260 and 26 are compressed by the package windings against the external surface 22*a* of the first tubular portion 22, as indicated by the dotted lines in FIG. 12*b*. Correspondingly, the semi-circular positioning element 158 is pushed bodily radially inwardly of the first tubular portion 22, so that the outer curved surface of the connecting portion 164 lies along the dotted line shown in FIG. 12*b*. The semi-circular positioning element 158 is, however, still spaced from a surface 149 defining the base of the radial slot 151. In other respects, the mode of operation is the same as that described for removal of outboard and inboard bobbin tubes 260 and 26 without packages 28.

Where the chuck 10 is designed to carry only two inboard and outboard bobbin tubes 26 and 260, there is only one axial gap 46 and only one pair of semi-circular positioning elements 158. When there are more than two inboard and outboard bobbin tubes 26 and 260, however, an axial gap 46 must be formed between the neighboring ends of each pair of successive bobbin tubes 26 and 260, and there must be a separate pair of semi-circular positioning elements 158 for each axial gap 46. For the inboard pair of semi-circular positioning elements 158, operation during removal of the outboard and inboard bobbin tubes 260 and 26 will be as described immediately above with reference to FIGS. 12*a* to 12*c*. This will be true also for all the other semi-circular positioning elements 158 if all outboard and inboard bobbin tubes 260 and 26 are moved together, for example, by engagement of a "push-off" shoe with the inboard end of the inboard bobbin tube 26. It will not apply to the other semi-circular positioning elements 158, however, where the outboard and inboard bobbin tubes 260 and 26 are removed successively, starting with the outboard bobbin tube 260. In such a case, during removal of the second bobbin tube 26A (the bobbin tube 26A following the outboard bobbin tube 260), the outboard semi-circular positioning elements 158 will return to the starting positions as shown in FIG. 12*a*, although at least one bobbin tube 26A is still located further inboard on the chuck 10. Movement of such a bobbin tube 26A past the outboard semi-circular positioning elements 158 is illustrated in FIGS. 12*d*, 12*e* and 12*f*.

Figure 12D:
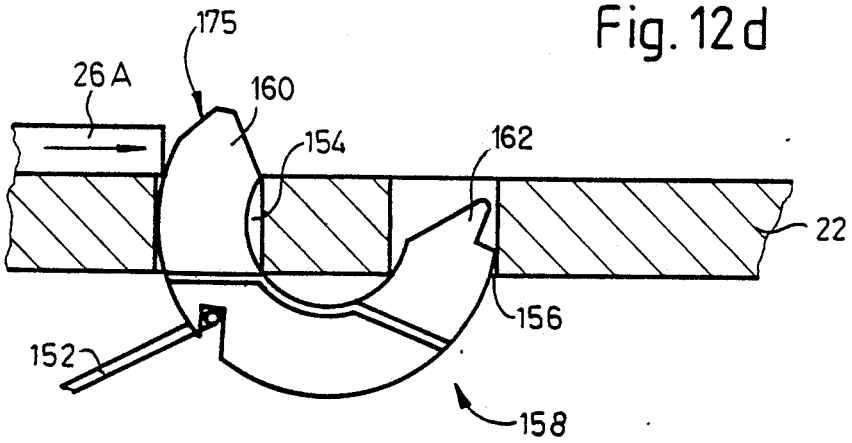
Figure 12E:
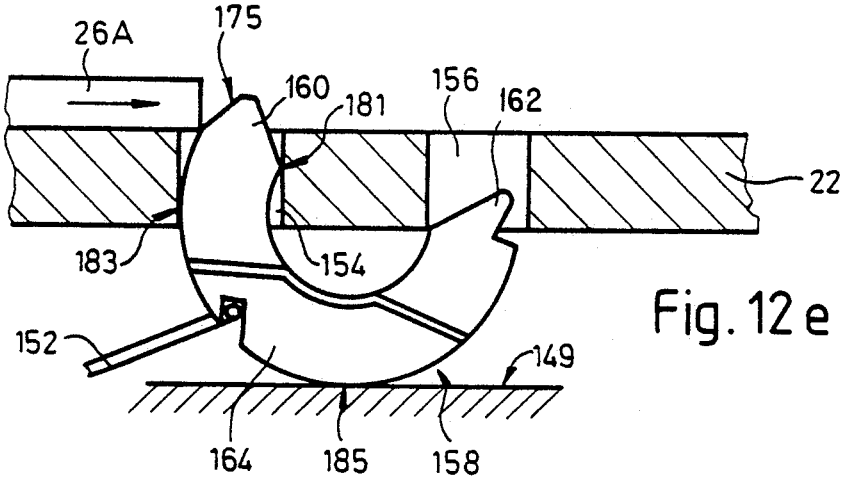

In FIG. 12*d*, the bobbin tube being moved-off the chuck 10 is designated by the reference character 26A; it is assumed to bear a package 28, so that its internal surface is in contact with the external surface 22*a* of the first tubular portion 22; the bobbin tube 26A is being moved to the right as viewed in FIG. 12*d*, towards the free end of the chuck 10, and is approaching an outboard semi-circular positioning element 158 which is in its starting position as also shown in FIG. 12*a*.

The outboard end of the bobbin tube 26A rides onto the outer curved surface of the first arm 160 and from there onto the chamfer 175. In doing so, it drives the first arm 160 radially inwardly along its radial bore 154. In addition, however, it applies a turning moment or torque to the semi-circular positioning element 158 which prevents the arm or spring of the pair of arms or springs 152 from forcing the second arm 162 outwardly through its radial bore 156. Instead, the inner curved surface of the first arm 160 is forced into contact with the outboard side or wall of the radial bore 154, as indicated at 181 in FIG. 12*e*, while the semi-circular positioning element 158 is forced bodily radially inwardly in its radial slot 151. The arm or spring of the pair of arms or springs 152 is, however, still effective for holding the outer curved surface of the first arm 160 in contact with the inboard side or wall of the radial bore 154, as indicated at 183 in FIG. 12*e*. The radially inward movement of the semi-circular positioning element 158 continues until the outer curved surface of the connecting portion 164 comes into contact with the surface 149 in the radial slot 151, as indicate at 185 in FIG. 12*e*.

Figure 12F:
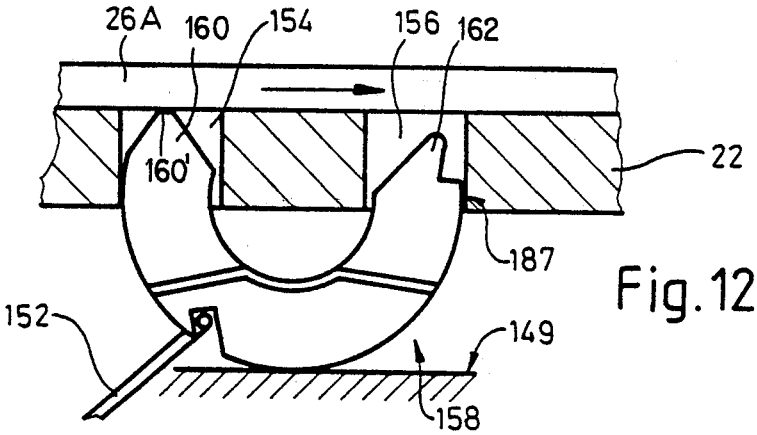

With continued movement of the bobbin tube 26A to the right, the flat end 160 ' of the first arm 160 comes into contact with the internal surface of the bobbin tube 26A as shown in FIG. 12*f*. In moving to this position from the position shown in FIG. 12*e*, the second arm 162 is forced radially outwardly along its radial bore 156, while sliding contact is maintained between the outer curved surface of the connector or connecting portion 164 and the surface 149 in the radial slot 151. Contact may also be made between the outer curved surface of the second arm 162 and the outboard side or wall of the radial bore 156, as indicated at 187 in FIG. 12*f*. As before, the arm or spring of the pair of arms or springs 152 maintains contact between the outer curved surface of the first arm 160 and the inboard side or wall of the radial bore 154. As soon as the bobbin tube 26A passes over the free end of the first arm 160, the semi-circular positioning element 158 is free to return to its starting position as indicated in FIG. 12*a* under the influence of the arm or spring of the pair of arms or springs 152. It will be noted from FIG. 12*e* that the second arm 162 at no time leaves its radial bore 156, so that the semi-circular positioning element 158 is always securely retained relative to the first tubular portion 22, although there may be some slight variation in the disposition of the semi-circular positioning elements 158 from case to case because of play in the guidance and locating systems provided by the radial bores 154 and 156.

Thread catching

Angularly displaced from the bore pair or pair of radial bores 154 and 156, the first tubular portion 22 has four further bores 176 (cf. FIG. 13) communicating with the compartment 148. These further bores 176 (only one of which is . illustrated) are equiangularly distributed around the axis of rotation 20. The support ring 150 (cf. FIG. 14) has four additional radial slots 155 aligned with respective openings defined by the further bores 176. Each further bore 176 receives a thread catching and severing device generally designated by the reference numeral 178 in FIG. 13 and equivalent to the thread catching and severing elements 48 in FIG. 1.

Each thread catching and severing device or element 178 comprises a radially outer head portion 180, an intermediate body portion 182 and a radially inward foot portion 184. The radially outer head portion 180 comprises an axially projecting tooth 186 and a radially movable clamping pin 188 cooperable with the "underside" (radially inwardly facing surface) of the axially projecting tooth 186 to form a clamping point. The radially movable clamping pin 188 is radially movable in a suitable bore (not shown) in the intermediate body portion 182 and is pressed outwardly against the underside of the axially projecting tooth 186 by centrifugal force when the chuck 10 is rotating in operation. The arrangement of the axially projecting tooth 186 and its cooperation with the radially movable clamping pin 188 are disclosed in the aforementioned U.S. Pat. No. 4,106,711, the full disclosure of which is incorporated herein by reference. An alternative arrangement, which can be adapted to the system shown in FIG. 13, is shown in the aforementioned U.S. Pat. No. 4,477,034, the disclosure of which is also incorporated herein by reference.

As indicated by the double-headed arrow in FIG. 13, the thread catching and severing device 178 is bodily movable in generally radial directions between an operating position (shown in FIG. 13) in which the radially outer head portion 180 projects from the external surface 22*a* of the first tubular portion 22, and a retracted position (not shown) in which the radially outer head portion 180 lies within the external surface 22*a* of the first tubular portion 22.

As the radially outer head portion 180 is drawn back or retracted into the opening defined by the further bores 176, the radially inward foot portion 184 and the intermediate body portion 182 are drawn radially inwardly into the additional radial slot 155 in the support ring 150. This radially inward movement of the thread catching and severing device 178 can continue until the radially outer head portion 180 lies within the further bores 176. Movement of the thread catching and severing device 178 in the radially outward direction is limited by shoulders 190 on the radially inward foot portion 184 engaging the internal surface 22*b* of the first tubular portion 22 as illustrated in FIG. 13. As seen in FIG. 14, the radially inward foot portion 184 has flat side faces (facing in the circumferential direction relative to the chuck 10). These flat side faces slide smoothly on the side walls of the respective additional radial slot 155, which therefore provides guidance for the thread catching and severing device 178 in its movement between the retracted and the operative positions.

The first tubular portion 22 has a circumferential groove 192 (FIGS. 10 and 13, omitted from FIG. 12) axially spaced from the openings defined by the further bores 176 on the outboard side thereof. As clearly seen in FIG. 10, this circumferential groove 192 is aligned with the axial gap 46 when the adjacent inboard and outboard bobbin tubes 26 and 260 are correctly located. Accordingly, during a thread catching operation, a thread extending substantially at right angles to the axis of rotation 20 can be laid in the circumferential groove 192, as indicated at 194 in FIG. 13, and can then be moved axially of the chuck 10 into the radially outer head portion 180 (as indicated by the arrow 196 in FIG. 13). Once in the radially outer head portion 180, the thread will be caught in the clamping position provided by the engagement of the radially movable clamping pin 188 with the underside of the axially projecting tooth 186 (as described in the aforementioned U.S. Pat. No. 4,106,711) and the thread portion downstream from the clamping position will be severed, as described in the same patent. Further axial movement of the thread upstream from the clamping position will onto the inboard bobbin tube 26 inboard thereof, so that package winding can begin.

In the illustrated embodiment, the thread catching , and severing device 178 is biased radially inwardly towards the retracted position so that a radially outward force is required to carry it into the operative position. As will be understood by referrring to FIGS. 10 and 13, the retracting system comprises a carrier disc 198 mounted on the common fluid pressure medium supply conduit or tube 66 and supporting four spring arms 200 extending axially from the carrier disc 198 into the respective additional radial slots 155. The free end of each spring arm 200 engages in a groove 202 provided in the radially inward foot portion 184 of the associated thread catching and severing device 178. Each spring arm 200 is arranged to apply biasing force to its associated thread catching and severing device 178 tending to draw the associated thread catching and severing device 178 radially inward.

A suitable means providing the outward force to overcome the bias applied by the spring arms 200 has not been illustrated in this application since it does not form subject matter of this invention. Correspondingly, the part of the radially inward foot portion 184 radially inwardly of the circumferential groove 202 has been omitted.

Merely as an example, by suitable modification of the system disclosed in the aforementioned European Pat. No. 470, movement of the outboard bobbin tube 260 shown in FIGS. 10 and 13 to its positioning engagement with the stop surface 172 (cf. FIG. 10) could be made to apply a mechanically derived force to urge the thread catching and severing devices 178 into their extended positions. Alternatively, the support ring 150 could include a fluid pressure medium-operated device for applying the required force to the thread catching and severing device 178 to drive it into the radially outward position against the bias applied by the spring arm 200. The thread catching and severing device 178 could be pressurized from the common fluid pressure medium supply conduit or tube 66 but would have to be controlled to operate in the inverse mode relative to the bobbin tube-engaging elements 34, since those bobbin tube-engaging elements 34 have to be forced radially outwardly at the time when the thread catching and severing devices 178 have to be retracted to their retracted positions. In a further alternative, the biasing system could be reversed so that the spring bias is effective to urge the thread catching and severing devices 178 to their operative positions, and a fluid pressure medium-operated device provided to retract them to the retracted positions. In this case, retraction of the thread catching and severing devices 178 could be effected in synchronism with the release of the gripping systems for the inboard bobbin tubes 26, generally as described in the aforementioned U.S. Pat. No. 4,336,912.

At the free end of the chuck 10, shown in FIG. 5, a support ring 114 has been illustrated. This support ring 114 seals with the internal surface 22*b* of the first tubular portion 22 to close-off the pressurizable compartment 116. In addition, the support ring 114 is provided with slots (not shown) for receiving thread catching and severing elements identical with those shown in FIGS. 13 and 14. The first tubular portion 22 is provided with corresponding bores (not shown) to permit a radially outward movement of these thread catching and severing elements for cooperation with the outboard end of the outboard bobbin tube 260 in operation. The support ring 114 is not, of course, provided with bobbin tube positioning elements similar to those shown in FIGS. 10 and 11.

Modifications

Various aspects of the invention as defined hereinbefore are not limited to their individual embodiments as illustrated in the drawings. It is not essential to provide a chuck 10 with thread catching and severing elements moving through bores therein. Where the chuck 10 is to be used in winding of thread packages or packages 28 of relatively fine threads, which break easily, the threads can be caught in slots in the bobbin tubes 26 and 260 and can be severed between incoming and outgoing bobbin tubes 26 and 260 simply by tensile forces created in the length of thread between them. Even where a specifically designed thread catching and severing structure is required, it may not be incorporated in the chuck structure, but may be provided in rings mounted on the structure between successive bobbin tubes thereon, for example as described in the aforementioned U.S. Pat. No. 4,477,034. In the latter case also, no bobbin tube positioning devices are required, since the bobbin tube positioning function is performed by the rings which provide the thread catching and severing devices.

In the embodiment shown in FIG. 4, the arrangement is such that the mechanical biasing systems (not specifically illustrated) urge the wedging cones 76 and 100 away from each other, while the pressurizable compartments 78 and 104 can be pressurized to urge the wedging cones 76 and 100 towards each other. This enables the inboard compartment 88 and the outboard compartment 90 containing the mechanical biasing means to be of substantial length relative to the associated pressurizable compartments 78 and 104. This will usually be the most desirable arrangement, but could be reversed if adequate axial force could be derived from a relatively short mechanical biasing means.

In the preferred arrangement, all parts within the first tubular portion 22 are centered relative to the internal surface 22*b* of the first tubular portion 22. This is true of both the piston elements 74 and 98 and the annular wall 96 and the annular end wall 102 associated with the wedging cones 76 and 100, respectively. Accordingly, each piston element 74 and 98 is preferably separable from its corresponding annular wall 96 and annular end wall 102, being joined thereto by way of the axial projection, for example, projection 84 shown on piston element 74 in FIG. 4. This enables separate insertion of the piston and wall elements into the chuck assembly, thus facilitating the assembly of the complete bobbin tube gripping structure with the bobbin tube-engaging elements 34 engaging the wedging cones 76 and 100 and located in their respective bores in the first tubular portion 22. Separate formation of the piston element and wedging cone portions may not, however, be necessary if centering of the assembly by the piston element alone is adequate, or if the assembly can be centered on both the internal surface 22*b* of the first tubular portion 22 and the external surface of the central tubular structure constituted in FIG. 4 by the common fluid pressure medium supply conduit or tube 66 and the tube or sleeve 94.

As already described, each bobbin tube-engaging element 34 is preferably made of a synthetic plastic material. The preferred material is polyoxymethylene or polyacetal. The particularly important characteristics of this material are its form or dimensional stability, even when subjected to moisture, sliding capacity and wear resistance. Other materials having adequate properties in this regard could also be used, however.

The embodiment of the invention requiring a "one-piece" or "integral" tubular body for the chuck 10, implies that this tubular body, when made of metal, be made from a single pre-formed blank. The use of two pre-formed blanks joined together is excluded, even where an intimate join is made between the bodies of metal by joining techniques such as welding. The blank to be used depends upon the manufacturing technique employed. For example, a bar-blank could be machined to provide the reduced diameter end portion and bored to provide the passage 40 and the chamber 30. Alternatively, a tube-blank could be swaged or forged on a suitable die to give the two required tubular portions. It will be clear, however, that the other embodiments of the invention are not limited to use with a tubular body formed in this way. They could equally well be applied where a joining technique is used to connect the cantilever or axially projecting portion 14 to its bearing portion 12, or where a support shaft projects into the interior of an outer tube and bearings are provided between them. However, the first embodiment of the invention enables optimum structural design (strength, stiffness, etc.) of both parts of the tubular body without necessitating compromises in the operating functions which are associated with the parts in operation (bearing design, including lubrication; thread package gripping and centering, etc.).

As previously referred to, the inboard and outboard moving devices 68 and 70 preferably operate independently of each other. Where total independence is not required, the intermediate bulkheads 86 can be eliminated and a "common" biasing means can be provided for both devices.

As also referred to above, the preferred arrangement is one in which each individual ring element 87 of the biasing means is firmly centered relative to the axis of rotation 20, and this is preferably effected by ensuring centering contact of each ring element 87 with the internal surface 22*b* of the first tubular portion 22. For this purpose, the outer edge or circumference of each individual ring element 87 may have a sufficient axial extent (dimension) to ensure the required centering contact referred to above for all assembled conditions in use.

The system as described immediately above is generally conventional. In a preferred embodiment, however, the biasing means comprises a body of resiliently compressible material extending between axial end members provided in the illustrated embodiment by the intermediate bulkhead 86 and the annular wall element 92 defining the ends of the inboard compartment 88. The body of resilient material can be arranged to fill, or substantially fill, the column or volume of the inboard compartment 88, and the material should be chosen to have a high degree of volumetric compressibility and a low degree of compressive set. The body can be made of a plurality of elements, for example rings, with the axially facing surfaces arranged in face-to-face contact with each other. In this regard reference may be had to the commonly assigned, copending U.S. application Ser. No. 919,652, filed Oct. 16, 1986, entitled "ACTUATING SYSTEM FOR A BOBBIN TUBE GRIPPER".

Means may be provided to ensure return of the bobbin tube-engaging or gripping, i.e. clamping, elements 34 radially inwardly as the wedging cones 76 and 100 are moved by pressurization of the pressurized chambers 78 and 104 (FIG. 4) and 116 (FIG. 5). For example, a biasing spring could be made to act between the outwardly extending projections or legs 26 (FIG. 7) and the internal surface 22*b* of the first tubular portion 22. Alternatively, a spring similar to the springs or arms 152 could be provided to act on the outwardly extending projections or legs 126 to draw the bobbin tube-engaging elements 34 radially inwardly. As a further alternative, the outwardly extending projections or legs 126 could themselves be made resiliently deformable to provide a radially inward bias when pressed against the first tubular portion 22.

The expression "cantilever-mounted" (where used in this specification) refers to the free extension of the "first tubular portion 22" (the package-holding portion) away from the bearings 18 supporting the "second tubular portion 24". The expression does not refer in any way to the structure in which those bearings 18 are mounted. In a continuous (or "wasteless") winder, the support structure may be provided by a rotatable head carrying two such chucks 10 (a "revolver head"), or there may be an independent swing arm for each chuck 10—or any other suitable support. In a single chuck winder, the support structure may be fixed or movable relative to the machine frame. The expression does not exclude the possibility of temporary support for the "free" end of the chuck 10 during a winding operation.

While there are shown and described present preferred embodiments of the invention, it is to be distinctly understood that the invention is not limited thereto, but may be otherwise variously embodied and practiced within the scope of the following claims. Accordingly,

What we claim is:

1. A chuck comprising:

an elongated tubular portion rotatable about a longitudinal axis of rotation with an outer circumference adapted to receive at least one bobbin tube for rotation therewith to form a package;

said elongated tubular portion being formed with an internal chamber and at least one pair of openings;

an associated tube-positioning member with a first arm and a second arm;

means mounting said associated tube-positioning member in said internal chamber so as to be movable substantially radially inwardly and outwardly with respect to said longitudinal axis of rotation;

said mounting means mounting said associated tube-positioning member in said internal chamber for movement between a first position in which said first arm passes through one opening of said at least one pair of openings to project beyond said outer circumference of said elongated tubular portion while said second arm is located within said outer circumference and a second position in which said second arm passes through another opening of said at least one pair of openings to project beyond said outer circumference of said elongated tubular portion while said first arm is located within said outer circumference;

said mounting means mounting said associated tube-positioning member in said internal chamber for movement into an intermediate position between said first position and said second position in which both said first arm passes through said one opening of said at least one pair of openings to project beyond said outer circumference of said elongated tubular portion and said second arm passes through said another opening of said at least one pair of openings to project beyond said outer circumference of said elongated tubular portion during such time as said at least one bobbin tube positionally passes over both of said at least one pair of openings;

said first and second arms of said associated tube-positioning member each comprise a respective curved arm portion;

each said opening including wall means; and each curved arm portion of said first and second arms cooperating with said wall means of said respective one opening and said another opening for guiding said associated tube positioning member as it moves between said first, intermediate and second positions.

2. The chuck as defined in claim 1, wherein:

said mounting means for mounting said associated tube-positioning member includes means within said internal chamber for urging said associated tube-positioning member into said first position.

* * * * *

UNITED STATES PATENT AND TRADEMARK OFFICE

CERTIFICATE OF CORRECTION

PATENT NO. : 4,811,910

DATED : March 14, 1989

INVENTOR(S) : PETER BUSENHART et al

It is certified that error appears in the above-identified patent and that said Letters Patent is hereby corrected as shown below:

Column 11, line 57, after "is" please insert --important in this respect that, as far as possible, each bobbin--.

Column 20, line 5, after "will" please insert --then carry the thread over the axially projecting tooth 186--

Column 23, line 10, after "legs" please delete "26" and insert --126--

Signed and Sealed this

Seventeenth Day of October, 1989

*Attest:*

*Attesting Officer*

DONALD J. QUIGG

*Commissioner of Patents and Trademarks*